US009646581B2

(12) United States Patent
Landis

(10) Patent No.: US 9,646,581 B2
(45) Date of Patent: May 9, 2017

(54) SOUNDHOLE COVER ACCESSORIES

(71) Applicant: Stanley Landis, Burbank, IL (US)

(72) Inventor: Stanley Landis, Burbank, IL (US)

(73) Assignee: Stanley Landis, Burbank, IL (US)

( * ) Notice: Subject to any disclaimer, the term of this patent is extended or adjusted under 35 U.S.C. 154(b) by 0 days.

(21) Appl. No.: 14/957,127

(22) Filed: Dec. 2, 2015

(65) Prior Publication Data

US 2016/0163293 A1 Jun. 9, 2016

Related U.S. Application Data

(63) Continuation-in-part of application No. 14/561,587, filed on Dec. 5, 2014.

(51) Int. Cl.
*G10D 3/00* (2006.01)

(52) U.S. Cl.
CPC ..... *G10D 3/00* (2013.01)

(58) Field of Classification Search
CPC ..... G10D 3/00
USPC ..... 84/290
See application file for complete search history.

(56) References Cited

U.S. PATENT DOCUMENTS

| | | | | |
|---|---|---|---|---|
| 1,346,013 | A | 7/1920 | Galbraith | |
| D73,154 | S | 8/1927 | Abler | |
| 3,636,809 | A | 1/1972 | Ezaki | |
| 4,024,788 | A | 5/1977 | Dunlap | |
| D245,725 | S | 9/1977 | Stelling | |
| D254,312 | S | 2/1980 | Stelling | |
| 4,394,830 | A | 7/1983 | Damiano | |
| 4,632,003 | A | 12/1986 | Kopp | |
| 4,649,793 | A * | 3/1987 | Blackshear | G10D 3/00 84/453 |
| 4,748,886 | A | 6/1988 | de Byl | |
| 5,567,896 | A * | 10/1996 | Gottschall | G10D 3/02 84/294 |
| 5,637,823 | A | 6/1997 | Dodge | |
| D393,275 | S | 4/1998 | Andrenacci | |
| D430,194 | S | 8/2000 | Tanaka | |
| D430,592 | S | 9/2000 | Park | |
| D430,593 | S | 9/2000 | Park | |
| 6,369,304 | B1 | 4/2002 | Tucker | |
| D458,954 | S | 6/2002 | Solomon, Jr. | |
| 6,639,134 | B2 | 10/2003 | Schmidt | |

(Continued)

OTHER PUBLICATIONS

Various Images of Acoustic Guitar Sound Hole Cover, obtained from www.google.com, last visited Oct. 23, 2014.
Dean Markley, The Suppressor Acoustic Soundhole Cover, www.musiciansfriend.com, last visited Dec. 5, 2014.

(Continued)

*Primary Examiner* — Jianchun Qin
(74) *Attorney, Agent, or Firm* — Beem Patent Law Firm

(57) ABSTRACT

Soundhole cover accessories may act to prevent items from falling into the body of an instrument through its soundhole, such as guitar picks or the like. The accessories may include a body portion adapted to fit over the soundhole of the instrument and a mesh portion defined by a plurality of apertures that may be dimensioned so that items that may be used with the instrument (such as guitar picks) are substantially prevented from passing there through. The body portion may act as a base to which one or more adhesive fasteners may be attached. The body may be flexible or rigid, and may be placed over the soundhole and affixed into place by the adhesive fasteners.

20 Claims, 4 Drawing Sheets

(56) References Cited

U.S. PATENT DOCUMENTS

| | | | | |
|---|---|---|---|---|
| 6,681,661 | B2 | 1/2004 | LaLonde | |
| D502,495 | S | 3/2005 | Park | |
| D516,113 | S | 2/2006 | Park | |
| 7,074,992 | B2 | 7/2006 | Schmidt | |
| D563,457 | S | 3/2008 | Kitazawa | |
| D571,850 | S | 6/2008 | Small et al. | |
| 7,844,069 | B2 | 11/2010 | Banks | |
| 8,188,353 | B2 | 5/2012 | Glass | |
| 8,474,064 | B2 * | 7/2013 | Hardy, III | A42B 3/16 2/10 |
| 2009/0019984 | A1 | 1/2009 | Ouellette | |
| 2012/0006180 | A1 * | 1/2012 | Hamanaga | G10D 3/046 84/453 |
| 2012/0011983 | A1 | 1/2012 | Koumarianos | |
| 2012/0275635 | A1 * | 11/2012 | Chen | H04R 1/1075 381/380 |
| 2013/0276621 | A1 | 10/2013 | Bekerman | |

OTHER PUBLICATIONS

D'Addario Planet Waves, The O-Port, www.planetwaves.com, last visited Dec. 5, 2014.

Carl Maloney, 7billionideas.com, last visited Oct. 23, 2014.

Luthier Guitar, Anti-Feedback for Acoustic guitars, www.luthierguitar.com, last visited Oct. 23, 2014.

Planet Waves, Planet Waves Screeching Halt, www.dv247.com, last visited Oct. 23, 2014.

Fiascos of the Fortune Minded, Breaking and Remaking, www.fiascosofthefortuneminded.wordpress.com, last visited Oct. 23, 2014.

* cited by examiner

SOUNDHOLE COVER ACCESSORIES

RELATED APPLICATION

The present application is a continuation-in-part of U.S. patent application Ser. No. 14/561,587 filed Dec. 5, 2014, which is incorporated herein by reference in its entirety.

BACKGROUND OF THE INVENTION

1. Technical Field

The present application relates to accessories for stringed instruments and more specifically, for guitars.

2. Related Art

Guitarists enjoy a love/hate relationship with their picks—they love the feeling they get when playing with that perfect pick but hate the fact they are often losing their grip on it. When that pick does get away, the force applied by the tension of the strings can cause the pick to fly in chaotic fashion. The problem is even worse for acoustic guitar players, as the string tension and action of an acoustic guitar is typically high. As a result, runaway picks often fly directly into the soundhole of the guitar. Once inside, the picks can get stuck on the geometry inside the guitar cavity and can be difficult to retrieve. During live performances, this problem can literally be show stopping if another pick is not at the ready, and the runaway pick can still clank around inside the guitar, distracting the guitarist and/or creating inadvertent noise.

Currently, there are devices that fit within a soundhole of an instruments that may block some or all of the soundhole. For example, suppressor devices are designed to alter the sound emanating from the soundhole. Guitarists often place one or more pickups in or about the soundhole of an acoustic instrument. A pickup is a transducer that captures mechanical vibrations from stringed instruments and converts them to an electrical signal that can be amplified, recorded, or the like. Because the sound waves emanating from the soundhole may also be "picked up" by the pickup, feedback can occur. To reduce or eliminate feedback, the guitarist may use a suppressor device to suppress the sound emanating from the soundhole. The suppressor devices are usually made of thick rubber, and while they may also help to prevent items from falling into the soundhole, the sound altering properties of these products are not always desirable.

In another example, decorative soundhole covers are available for concealing speakers and electronic controls contained with the cavity of a guitar. However, these products require an elaborate installation process and many guitarist do not need or want the electronics products these covers are meant to conceal.

Accordingly, a need has long existed for an improved guitar accessory item.

SUMMARY

In various embodiments, soundhole cover accessories may act to prevent items from falling into the body of an instrument through its soundhole, such as guitar picks or the like. The accessories may include a body portion adapted to fit over the soundhole of the instrument and a mesh portion defined by a plurality of apertures that may be dimensioned so that items that may be used with the instrument (such as guitar picks) are substantially prevented from passing there through. The body portion may act as a base to which one or more adhesive fasteners may be attached. The body may be flexible or rigid, and may be placed over the soundhole and affixed into place by the adhesive fasteners.

Other systems, methods, features and advantages of the invention will be, or will become apparent to one with skill in the art upon examination of the following figures and detailed description. It is intended that all such additional systems, methods, features and technical advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention.

DETAILED DESCRIPTION OF THE PREFERRED EMBODIMENTS

The elements illustrated in the Figures interoperate as explained in more detail below. Before setting forth the detailed explanation, however, it is noted that all of the discussion below, regardless of the particular implementation being described, is exemplary in nature, rather than limiting. For example, although several embodiments are described concerning an accessory for use with a guitar, accessories may also be provided for use with other instruments.

Figure 1:
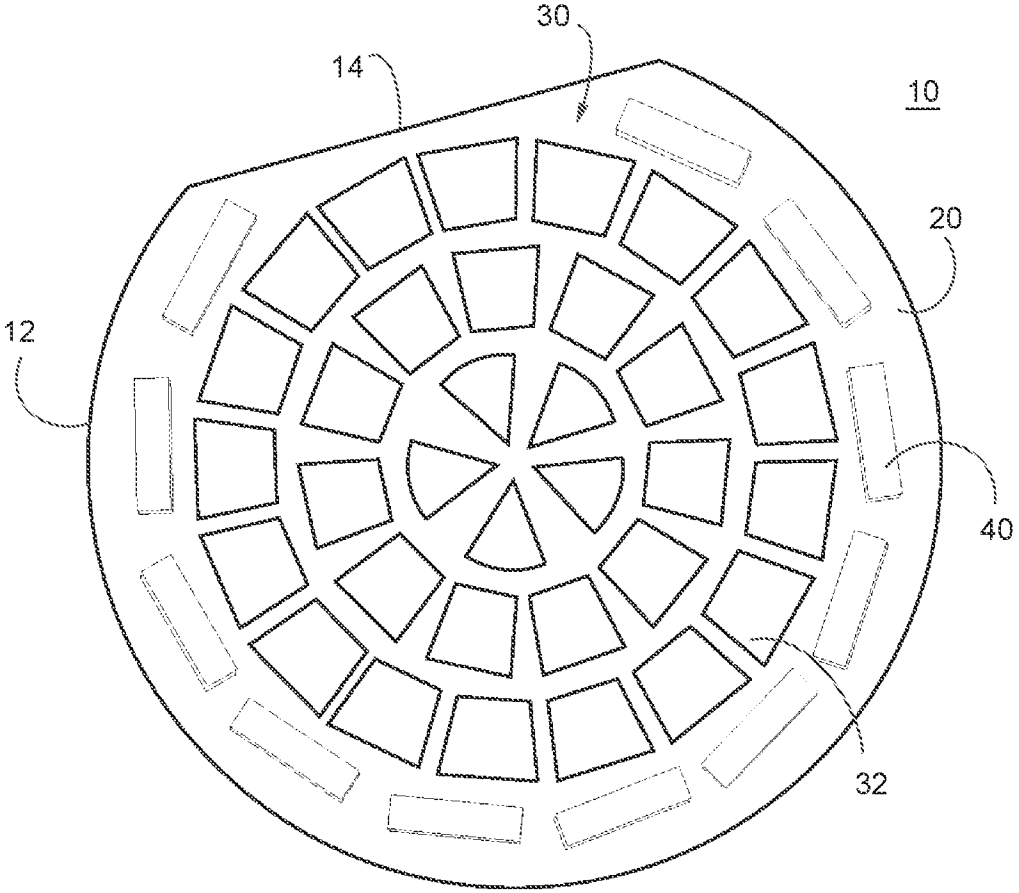
FIG. 1 shows a bottom view of an exemplary guitar accessory.
Figure 2:
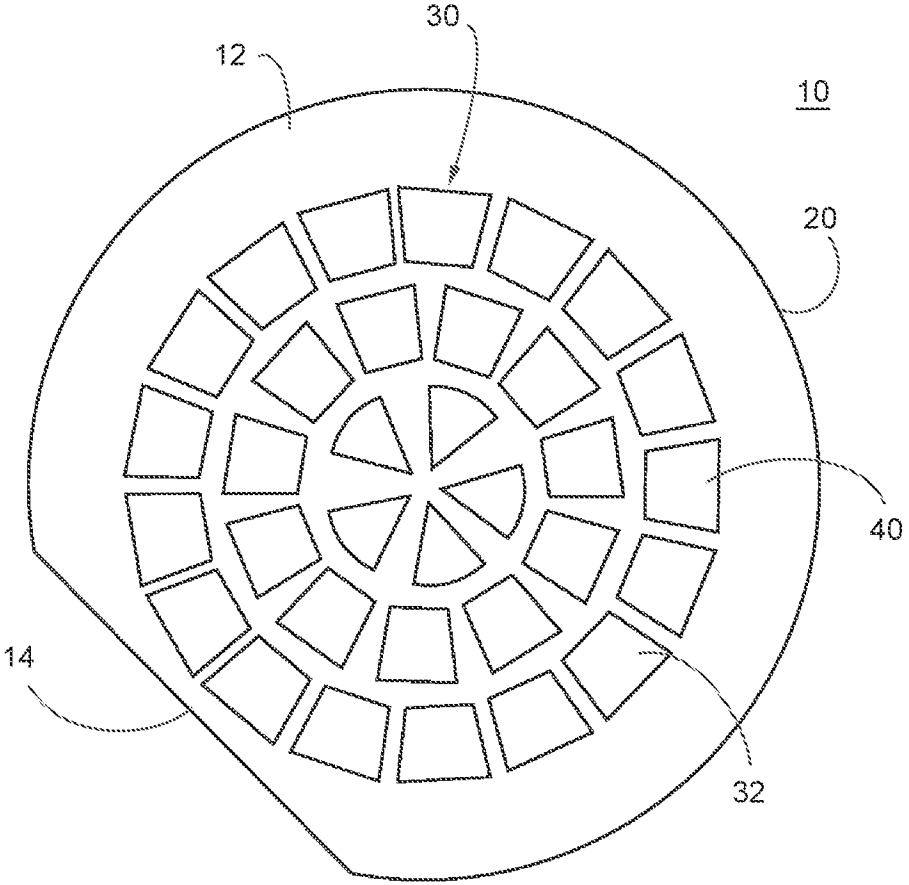
FIG. 2 shows a top view of the exemplary guitar accessory of FIG. 1.
Figure 3:
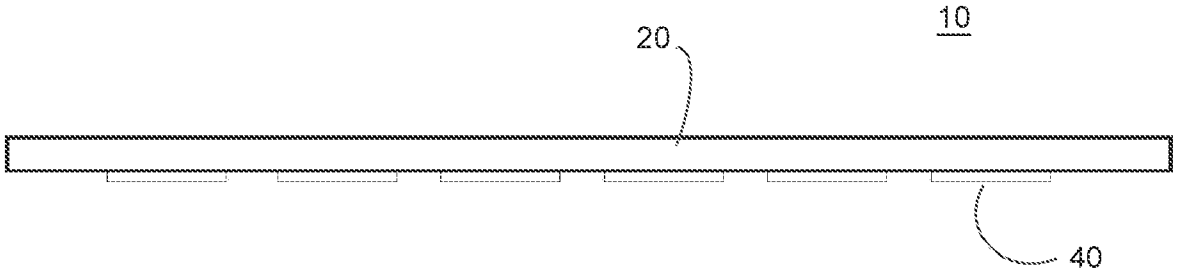
FIG. 3 shows a side view of the exemplary guitar accessory of FIG. 1.
Figure 4:
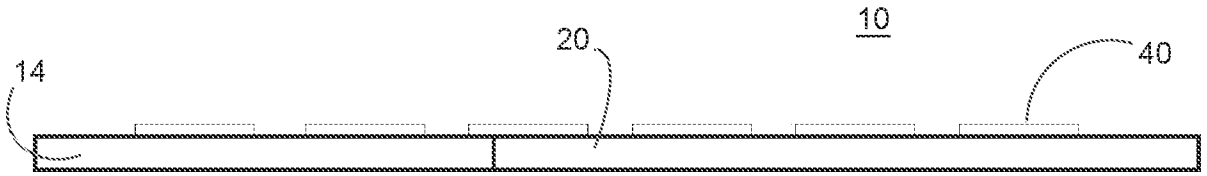
FIG. 4 shows another side view of the exemplary guitar accessory of FIG. 1.

Referring to FIG. 1, an exemplary accessory 10 for use with a guitar is shown. The accessory 10 may fit over a guitar's soundhole and prevent items such as guitar picks from falling into the guitar's body through the soundhole. The accessory 10 may include a body portion 20 and a mesh portion 30 defined by a plurality of apertures 32. The accessory 10 also may include one or more fasteners 40. In some embodiments, such as the embodiment shown in FIG. 1, the accessory 10 may include a side portion 14 that may accommodate physical features of the instrument, such as the neck of a guitar.

The body portion 20 may be dimensioned so as to prevent items such as guitar picks from falling into the soundhole of an instrument. The body portion 20 may be adapted to fit on top of the soundhole. The body portion 20 may be substantially the same size and shape as an instrument's soundhole, or it may be larger than the soundhole or may be shaped differently than the soundhole. In some embodiments, the body portion 20 is substantially circular. Other shapes also may be used.

In the illustrated embodiment, the body portion 20 has a substantially circular disc-shape including an outer perimeter 12 and a substantially straight side portion 14. In various embodiments, the diameter of the outer perimeter 12 may vary in length. In the illustrated embodiment, the fasteners 40 are disposed about the outer perimeter 12. In such an embodiment, the outer diameter 12 may be dimensioned so that the fasteners 30 may simultaneously engage the guitar's soundboard or top near the soundhole. For example, soundholes may be about three and one-half inches, about three and five-eighths inches, about three and seven-eighths inches, about 4 inches, and the like. Accordingly, the diameter of the outer perimeter 22 may vary with the size and/or placement of the fasteners 40. In various embodiments, the diameter of the outer perimeter 12 preferably may be between about one-eighth inch and about one and one-fourth inches larger than the diameter of the guitar soundhole, more preferably between about one-quarter inch and one inch of the diameter of the guitar soundhole, even more preferably between about three-eighths inch and about seven-eighths inch of the diameter of the guitar soundhole, and/or even further preferably within about one-half inch of the size of the diameter of the diameter of the guitar soundhole. Other lengths may also be used. For example, in the illustrated embodiment, the diameter of the outer perimeter 22 may be about four and seven-sixteenths inches for use in a guitar having a four inch soundhole.

The body portion 20 may be made of any suitable material. In some embodiment, the body portion 20 may be made of a rigid material such as acrylic, carbonite, or the like. In other embodiments, the body portion 20 may be made of a semi-rigid, flexible material such as plastic, rubber or the like. Other materials may also be used. The use of a flexible material may ease the installation of the accessory 10 because a guitar player may bend the accessory 10. In some embodiments, combinations of rigid and flexible materials may be used.

The thickness of the body portion 20 may vary depending on a variety of factors. For example, in embodiments that secure to the top of the soundhole, a thin body portion 20 may be desirable so that the accessory 10 does not contact the strings of the guitar during a performance. For example, a thickness between about one-thirty-seconds of an inch and three-eighths inch may be used in some such embodiments. In the embodiment shown in FIGS. 5*a* and 5*b*, the body portion 20 may be about one-sixteenth inch thick.

To secure the accessory 10 item to the instrument, the accessory 10 may include one or more fasteners 40. In some embodiments, the fasteners 40 are disposed near an outer perimeter 12 of the body portion 20. Alternatively, or additionally, the fasteners 40 may be disposed elsewhere on the body portion 20. The fasteners 40 may be adhesive strips, such as double-sided tape or the like, for securing to the soundboard or top of the instrument. Other types of fasteners 30*a-c* also may be used. For example, a fastener 32 may comprise a recess provided in the body portion 20 that engages the perimeter of the soundhole. Fasteners 40 may be made of any suitable material. Preferably, fasteners 40 may utilize an adhesive strong enough to allows the accessory 10 to be securely affixed to the instrument while at the same time allows for removal of the accessory 10 without the possibility of damaging the body of the instrument.

In the illustrated embodiment, eleven fasteners 40 are provided. More or less fasteners may be used. The fasteners 40 may be disposed about the outer perimeter 12 of the body portion 20 in about equidistant from one another. Other configurations also may be used. For example, sets of fasteners 40 may be grouped closer to one another on certain sections of the body portion 20 than on other sections. In the illustrated embodiment, no fasteners 40 are provided on the side portion 14. Alternatively or additionally, one or more fasteners 40 may be provided along the side portion 14. Fasteners 40 may be uniformly sized, or various size fasteners may be used.

Referring again to FIG. 1, the mesh portion 30 may be defined by a plurality of apertures 32 and may be disposed in the body portion 20 so as to cover the soundhole while allowing sound waves to exit. In some embodiments, the mesh portion 30 is the only portion of the body 10 that cover the soundhole of the instrument. Alternatively, some of the body portion 20 also may cover the instrument's soundhole. The mesh portion 30 may be made of plastic, spandex, or any other suitable material. The mesh portion 30 may be rigid or flexible, or include sub-portions of both rigid and flexible materials. In some embodiments where the body portion 20 is flexible, the mesh portion 30 also may be flexible. In embodiments where the body portion 20 is rigid, the flexibility of the mesh portion 40 may be less important. Preferably, the mesh portion 30 is made of the same material as the rest of the body portion 20 and the two are of a unibody construction, such as a single piece of plastic.

Apertures 32 may be dimensions so as to reduce and/or eliminate the possibility of other accessories that may be used to play an instrument, such as a guitar pick or the like, may fall into its soundhole. For example, for accessories 10 designed to be used with guitars, each aperture 32 may be dimensioned so as not to exceed about a one inch opening across its widest dimension. Preferably, the opening across the widest dimension of an aperture 32 is between about one-eighth of an inch and about one-inch, more preferably between about one-quarter of an inch and about three-eighths of an inch, and even more preferably between about one-third of an inch and about two-thirds of an inch. In the illustrated embodiment, the apertures 32 may be about one-half an inch wide at their widest dimension.

Apertures 32 may vary in shape and size. Each aperture 32 be the same shape, or different shapes may be used for different apertures 32. For example, in the illustrated embodiment, substantially triangular shaped apertures 32 are provided near the center of the mesh portion 30, and substantially trapezoidal and substantially rectangular shaped apertures 32 are circularly disposed about center portion in two rows. Other shapes and arrangements also may be used. For example, an aperture 32 may be provided at the center of the body portion, or the apertures 32 may be exclusively triangular, trapezoidal or rectangular.

Figure 5:
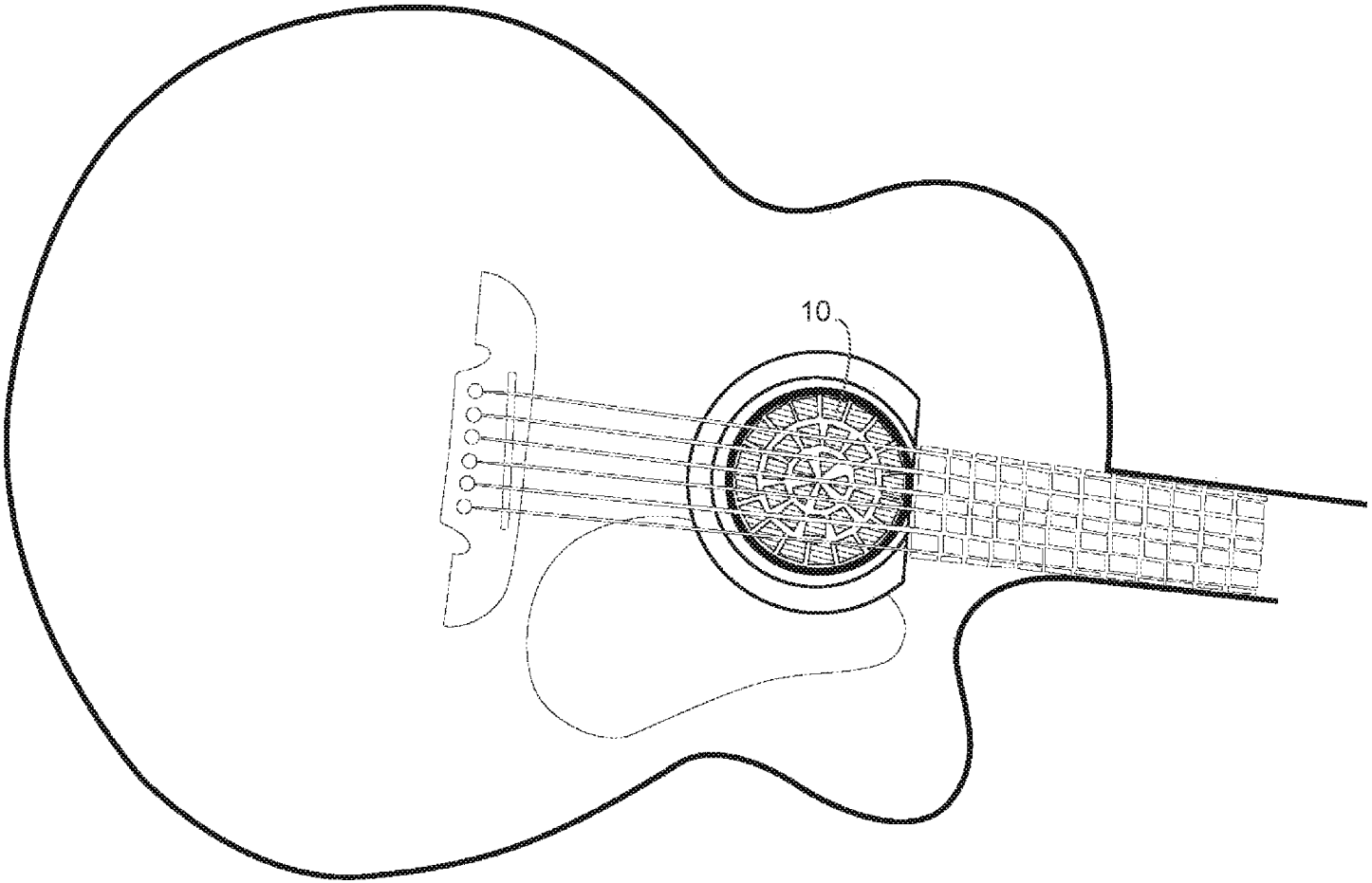
FIG. 5 an elevated view of a guitar equipped with the exemplary guitar accessory shown in FIG. 1.

FIG. 5 shows an elevated view of a guitar equipped with an exemplary guitar accessory 10 that sits on top of the guitar soundboard. In the illustrated embodiment, the body portion 20 is made of a clear, semi-flexibly plastic. Because the illustrated embodiment is adapted to sit on top of the guitar body, the body portion 20 of the accessory 10 includes a side portion 14 that is adapted to rest next the neck of the guitar. Other similar adaptations that may be necessitated or desirably in light of the particular components of any particular instrument will be apparent to one of ordinary skill in the art.

To install the accessory 10, the user may or may not remove the strings of the guitar. Next, the user may slide the accessory 10 into place around the soundhole with the fasteners 32 facing downward and align the side portion 14 against the end of the guitar's neck. Once in the desired position, the user may depress the fasteners 32 to affix the accessory to the soundboard. Once in place, the accessory 10 may prevent items such as guitar picks from falling into the guitar cavity without suppressing the sound of the guitar.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

I claim:

1. An accessory for use with an instrument-having a soundhole and at least one string comprising:

a body portion comprising a substantially circular disc shape including a circular outer perimeter with a substantially straight side portion, the body having a thickness from between about one thirty-second of an inch to about three-eighths of an inch, where the body portion is adapted to be positioned between said at least one string and the soundhole;

a mesh portion attached to the body portion, the mesh portion defined by a plurality of apertures and allowing sound waves to exit the soundhole substantially unsuppressed; and a plurality of adhesive fasteners disposed on the body portion.

2. The accessory of claim 1, where the body portion is flexible.

3. The accessory of claim 2, where the mesh portion is a flexible.

4. The accessory of claim 3, where the mesh portion is made from a different material than the body portion.

5. The accessory of claim 1, where the fasteners are adhesive strips.

6. The accessory of claim 5, where the fasteners are double-sided tape.

7. The accessory of claim 1, where the body includes a side portion adapted to accommodate a feature of the instrument.

8. The accessory of claim 7, where the body includes a side portion adapted to accommodate a neck of a guitar.

9. The accessory of claim 1, where the plurality of fasteners are disposed substantially equidistantly around a portion of a perimeter of the body portion.

10. The accessory of claim 1, where at least one of the plurality of fasteners is substantially triangularly shaped.

11. The accessory of claim 10, where a plurality of triangularly shaped apertures are disposed near a center of the mesh portion.

12. The accessory of claim 11, where a plurality of trapezoidally shaped apertures are disposed around the plurality of triangularly shaped apertures.

13. The accessory of claim 12, where a plurality of trapezoidally shaped apertures are circularly disposed around the plurality of triangularly shaped apertures.

14. The accessory of claim 1, where the body portion and the mesh portion comprises a single piece of plastic.

15. An accessory for use with an instrument-having a soundhole and at least one string comprising:

a flexible body portion having a substantially circular disc shape with a perimeter defined by the remainder of a circle with a circular segment removed, the body portion having a thickness from between about one-thirty seconds of an inch to about three-eighths of an inch, the flexible body portion including a flexible mesh portion defined by a plurality of apertures, where the body portion is adapted to be positioned between said at least one string and the soundhole;

a plurality of adhesive fasteners disposed on the body portion; and a flexible mesh portion attached to the flexible body portion, the mesh portion covering the soundhole without suppressing the sound of the instrument.

16. The accessory of claim 15, where the body portion and the mesh portion are plastic.

17. The accessory of claim 15, where the body portion includes a side portion adapted to accommodate the neck of a guitar.

18. An accessory for use with a guitar having a soundhole and at least one string comprising:

a rigid, plastic body portion having a mesh portion defined by a plurality of apertures, the rigid, plastic body portion having a thickness from between about one-thirty seconds of an inch to about three-eighths of an inch and a substantially straight side portion adapted to accommodate a neck of the guitar, the body portion adapted to fit between the soundhole and said at least one string allowing sound waves to exit the instrument substantially unsuppressed; and a plurality of fasteners disposed on the body portion and adapted to adhesively engage a soundboard of the guitar.

19. The accessory of claim 18, where a plurality of triangularly shaped apertures are disposed near a center of the mesh portion and a plurality of trapezoidally shaped apertures are circularly disposed around the plurality of triangularly shaped apertures.

20. The accessory of claim 19, where the plurality of fasteners are adhesive strips adapted equidistantly disposed around a portion of a perimeter of the body portion.

* * * * *